US008684241B2

(12) United States Patent
Minegishi

(10) Patent No.: US 8,684,241 B2
(45) Date of Patent: Apr. 1, 2014

(54) SQUEEZING DEVICE AND PACKAGING BAG FOR VISCOUS LIQUID

(75) Inventor: Haruo Minegishi, Kanagawa (JP)

(73) Assignee: Wallha Co., Ltd., Kanagawa (JP)

( * ) Notice: Subject to any disclaimer, the term of this patent is extended or adjusted under 35 U.S.C. 154(b) by 563 days.

(21) Appl. No.: 12/866,618

(22) PCT Filed: Feb. 9, 2009

(86) PCT No.: PCT/JP2009/052135
§ 371 (c)(1),
(2), (4) Date: Aug. 6, 2010

(87) PCT Pub. No.: WO2009/099231
PCT Pub. Date: Aug. 13, 2009

(65) Prior Publication Data

US 2011/0089193 A1 Apr. 21, 2011

(30) Foreign Application Priority Data

Feb. 8, 2008 (JP) ..... 2008-028361

(51) Int. Cl.
*B65D 5/72* (2006.01)
*B65D 30/08* (2006.01)
*B67D 7/60* (2010.01)
*B65D 35/28* (2006.01)

(52) U.S. Cl.
USPC ..... 222/567; 222/102; 222/391; 383/113

(58) Field of Classification Search
USPC ..... 215/43, 232, 370; 220/495.06, 601, 220/613; 222/95, 96, 101, 102, 105, 107, 222/386.5, 391, 567, 573; 383/109, 113
See application file for complete search history.

(56) References Cited

U.S. PATENT DOCUMENTS

| | | | | | |
|---|---|---|---|---|---|
| 1,841,275 | A | * | 1/1932 | Baptiste | 222/96 |
| 1,930,821 | A | * | 10/1933 | Newcomer et al. | 222/96 |
| 2,056,422 | A | * | 10/1936 | Crossley | 222/101 |
| 2,064,357 | A | * | 12/1936 | Ritterbusch | 222/93 |
| 2,140,007 | A | * | 12/1938 | Grandman | 222/96 |
| 2,357,351 | A | * | 9/1944 | Boyce | 222/102 |
| 2,901,147 | A | * | 8/1959 | Bond, Jr. | 222/102 |
| 3,221,940 | A | * | 12/1965 | Watson, Jr. | 222/96 |

(Continued)

FOREIGN PATENT DOCUMENTS

| | | | |
|---|---|---|---|
| JP | 57-159649 | U | 10/1982 |
| JP | 06-053469 | U | 7/1994 |

(Continued)

*Primary Examiner* — Kevin P Shaver
*Assistant Examiner* — Patrick M Buechner
(74) *Attorney, Agent, or Firm* — Kubotera & Associate LLC

(57) ABSTRACT

A squeezing device capable of squeezing a viscous liquid in a packaging bag includes a pair of bag body support parts for stretching and supporting the bag bodies by fixing the front end and the rear end of a bag body and performing fixing of the rear end by applying a tension thereto rearwards; a squeezing mechanism part which is so provided as to be capable of sliding in the direction towards the front end in such a state the rear end of the bag supported by the bag body support parts is held from the upper and lower sides; and a drive mechanism part for slidingly driving the squeezing mechanism part in the direction towards the front end. The squeezing mechanism part is installed at the tip end of the device, and the drive mechanism part includes a slide bar disposed parallel to the sliding direction of the squeezing mechanism part.

3 Claims, 4 Drawing Sheets

(56) References Cited

U.S. PATENT DOCUMENTS

| | | | | | |
|---|---|---|---|---|---|
| 3,249,258 | A | | 5/1966 | Kramer et al. | |
| 3,257,037 | A | | 6/1966 | Watson, Jr. | |
| 4,226,336 | A | * | 10/1980 | Young | 222/102 |
| 4,234,104 | A | * | 11/1980 | Apuzzo et al. | 222/94 |
| 4,265,949 | A | * | 5/1981 | Kugimiya | 383/106 |
| 4,805,805 | A | | 2/1989 | Ocheskey | |
| 4,997,661 | A | * | 3/1991 | Kromer et al. | 426/126 |
| 4,998,645 | A | * | 3/1991 | Pearson | 222/98 |
| 5,050,773 | A | * | 9/1991 | Choi | 222/63 |
| 5,195,659 | A | * | 3/1993 | Eiskant | 222/102 |
| 5,490,613 | A | | 2/1996 | Taylor et al. | |
| 5,560,518 | A | | 10/1996 | Catterall et al. | |
| 5,582,350 | A | | 12/1996 | Kosmyna et al. | |
| 5,593,066 | A | * | 1/1997 | Konuma et al. | 222/94 |
| 5,823,383 | A | * | 10/1998 | Hins | 220/601 |
| 5,996,845 | A | * | 12/1999 | Chan | 222/107 |
| 6,273,307 | B1 | * | 8/2001 | Gross et al. | 222/566 |
| 6,364,165 | B2 | * | 4/2002 | Sampson et al. | 222/102 |
| 6,454,133 | B1 | * | 9/2002 | Lopez et al. | 222/102 |
| 6,531,197 | B2 | * | 3/2003 | Neteler | 428/34.7 |
| 6,752,179 | B1 | | 6/2004 | Schwartz | |
| 2002/0170923 | A1 | * | 11/2002 | Vatman | 222/102 |
| 2003/0106902 | A1 | * | 6/2003 | Bolam | 222/92 |
| 2004/0236305 | A1 | | 11/2004 | Jansen et al. | |
| 2006/0102655 | A1 | * | 5/2006 | Hurst | 222/102 |
| 2007/0205202 | A1 | * | 9/2007 | Hildebrand et al. | 220/613 |
| 2009/0139993 | A1 | * | 6/2009 | Last | 220/601 |

FOREIGN PATENT DOCUMENTS

| | | | | | |
|---|---|---|---|---|---|
| JP | 07-088415 | A | | 4/1995 | |
| JP | 07-503928 | A | | 4/1995 | |
| JP | 07-289956 | A | | 11/1995 | |
| JP | 08-026306 | A | | 1/1996 | |
| JP | 10-278977 | A | | 10/1998 | |
| JP | 11-059705 | A | | 3/1999 | |
| JP | 2002-302146 | A | | 10/2002 | |
| JP | 2004-267773 | A | | 9/2004 | |
| JP | 2005-022654 | A | | 1/2005 | |
| JP | 2005-521602 | A | | 7/2005 | |
| JP | 2006-096369 | A | | 4/2006 | |
| JP | 2006-143286 | A | | 6/2006 | |
| JP | 2008063006 | A | * | 3/2008 | B65D 83/00 |
| WO | 00/10880 | A1 | | 3/2000 | |

* cited by examiner

SQUEEZING DEVICE AND PACKAGING BAG FOR VISCOUS LIQUID

FIELD OF THE INVENTION

The invention relates to a packaging bag for containing a sealing agent for watertight sealing in construction or an adhesive agent for bonding components. The invention also relates to a squeezing device for squeezing a viscous liquid as contents.

A container for a viscous liquid such as a sealing agent or an adhesive agent has been used in a large quantity in construction. As such a container, a filling container (a cartridge type), in which a bottom plate is disposed in a cylindrical body with a nozzle at a distal end thereof to be slidable in the cylindrical body toward the distal end, has been available in a market (for example, refer to Patent Reference 1). The cylindrical body may be made of paper or a resin such as polypropylene and the like. The filling container is attached to a discharge device called a caulk gun, so that a lever of the discharge device is operated to slide the bottom plate of the filling container like a piston toward the nozzle thereof.

In addition to the filling container with the cylindrical body, without the cylindrical body as the container, a filling container (a film package type) for containing contents in a sausage shape has been available in a market (for example, refer to Patent Reference 2). The film package type container has an advantage of significantly reducing waste after use. The film package type container, instead of using the cylindrical body as the container, uses a special caulk gun. The caulking gun is provided with an outer cylinder with a cylindrical shape for receiving the film package of a viscous liquid and a bottom plate capable of sliding like a piston from a rear end of the outer cylinder to a nozzle at a front end thereof.

Further, a squeezing multilayer container has been disclosed, in which "multilayer sheets are overlapped and joined together to form a cylinder body. An extrusion outlet with threads formed through an injection molding of a thermoplastic resin and a conical shoulder portion connected to the extrusion outlet are attached to one end of the cylinder body. The other end of the cylinder body is fused" (refer to Patent Reference 3). In addition, a tube squeezing apparatus has been disclosed, in which "two bar bodies are aligned in parallel with a slight space in between; and holding members are attached to hold both ends of the bar bodies, so that at least one of the holding members is freely removable from the bar bodies" (refer to Patent Reference 4).

Further, a squeezing apparatus for a reactive ink agent has been disclosed, in which "a first bar body is provided for forming a gap to insert a flexible container; a second bar body is provided for forming the gap with the first bar body, and has a size smaller than that of the first bar body; a gripper is to be griped by a hand for fixing one end of the first bar body and one end of the second bar body; and an end fixing part is provided for fixing the other end of the first bar body and the other end of the second bar body. The first bar body and the second bar body are fixed between the gripper and the end fixing part not to rotate" (refer to Patent Reference 5). In addition, a squeezing apparatus with a tube shape container has been disclosed, in which "a locking member is provided with locking parts formed at a predetermined interval; and two cylindrical rotating bodies are locked at the locking parts of the locking member and are disposed substantially in parallel to be rotatable for squeezing out a content of the tube shape container" (refer to Patent Reference 6).

In Patent Reference 3, it is disclosed that a packaging bag similar to a pouch bag is used as the squeezing container. The apparatus disclosed in Patent Reference 4 to 6 are configured such that an operator holds the apparatus with both hands to perform a squeezing operation. In Patent References 4 to 6, there is no suggestion for improvement so that an operator is able to operate the apparatus with a single hand.

It is noted that the filling container of the cartridge type described above has been mainly used for containing a sealing agent or an adhesion of a two-liquid type, in which two types of resins are mixed and used at a site.

Patent Reference 1: Japanese patent publication No. 07-88415

Patent Reference 2: Japanese utility model publication No. 06-53469

Patent Reference 3: Japanese patent publication No. 2006-096369

Patent Reference 4: Japanese utility model publication No. 57-159649

Patent Reference 5: Japanese patent publication No. 2006-143286

Patent Reference 6: Japanese patent publication No. 08-026306

DISCLOSURE OF THE INVENTION

Problems to Solve

In the filling container of the cartridge type described above, after a viscous liquid is squeezed out, the tube body still has a volume the same as that thereof before, thereby maintaining the same size and causing a disposal problem. Furthermore, the bottom plate at the rear end is not able to sufficiently seal the tube body, thereby causing a problem of hardening the content at the rear end due to deterioration over time. The filling container of the film pack type may have a configuration, in which a front end of the film container is cut, and the film container is inserted into the outer tube. In this case, a viscous liquid may adhere to a hand of an operator or inside the outer tube, thereby causing a staining problem.

In addition, the filling containers of both the cartridge type and the film pack type have the cylindrical shape. Accordingly, the filling container is attached to the discharge device to push out like a piston. When the tube body of the cartridge type does not have the cylindrical shape, it is difficult to prevent a leakage between the bottom plate and the tube body. When the front end of the filling container of the film type package is not equally pushed against a front end surface of the outer tube type, it is difficult to discharge a viscous liquid to the nozzle located at the center of the front end surface. In addition, since the filling containers of both types need to have the cylindrical shape, there is a space between the cylinders when the filling containers are stored in a piled state.

An object of the invention is to provide a squeezing device capable of smoothly squeezing a viscous liquid in a packaging bag utilizing a so-called "pouch bag". A further object of the invention is to provide a packaging bag for a viscous liquid, which can be manufactured with an existing pouch production facility. When the packaging bag is stored, it is possible to maintain good quality for a long period of time, and a large number of the packaging bags can be piled up and stored in a small space. When the packaging bag is used, it is possible to completely squeeze out the viscous liquid retained therein. After the packaging bag is used, it is possible to reduce a waste volume thereof.

SUMMARY OF THE INVENTION

In order to solve the problems mentioned above, according to the invention, a squeezing device is to squeeze out contents of a packaging bag. The packaging bag includes a bag body having a through hole at a front end thereof for pushing a viscous liquid as the contents outside. The bag body is formed of a bonded sheet material made of a synthetic resin. The sheet material is formed of a base film layer, a heat seal layer, and a film layer having a gas barrier function as an intermediate layer between the base film layer and the heat seal layer.

The squeezing device includes a pair of packaging bag support parts for fixing the front end and a rear end of the packaging bag, and for supporting the packaging bag with a tension toward a rear direction while fixing the rear end; a squeezing mechanism part disposed to be slidable toward a front end direction in a state that the squeezing mechanism part sandwiches from above and below the rear end of the packaging bag supported with the packaging bag support parts; a driving mechanism part for driving the squeezing mechanism part to slide toward the front end direction; and a slide bar having a distal end attached to the squeezing mechanism part and being arranged in parallel to a sliding direction that the driving mechanism part drives the squeezing mechanism part to slide.

According to the invention, a packaging bag for a viscous liquid includes a bag body formed of a bonded sheet material made of a synthetic resin. The sheet material is formed of a base film layer, a heat seal layer, and a film layer having a gas barrier function as an intermediate layer between the base film layer and the heat seal layer. The bag body has a through hole at a front end thereof for pushing the viscous liquid outside.

Especially, the packaging bag for a viscous liquid further includes a nozzle inserting piece with a flat shape in a fused state formed in a part of an edge of the bonded sheet material at the front end of the bag body; a nozzle guide hole formed in the nozzle inserting piece in a closed state for becoming the through hole when a rear end of a removable nozzle is inserted to the nozzle guide hole; and a nozzle hooking portion formed in the nozzle inserting piece for preventing the removable nozzle from coming off after the removable nozzle is attached to the nozzle inserting piece.

According to a preferred aspect of the invention, in the packaging bag for a viscous liquid, the nozzle hooking portion includes an L-shaped hooking piece extending from a side of the removable nozzle to the rear end, a hooked part formed at a distal end of the L-shaped hooking piece, and a hooking part formed at a side of the nozzle guide hole for hooking to the hooked part.

According to a further preferred aspect of the invention, the packaging bag for a viscous liquid has a fastener formed of a linear meshing portion extending in a width direction of the bag body at an inner face of a rear end edge of the bag body.

In the present invention, the squeezing device is to squeeze out the contents of the packaging bag. The packaging bag includes the bag body having the through hole at the front end thereof for pushing the viscous liquid as the contents outside. The bag body is formed of the bonded sheet material made of the synthetic resin. The sheet material is formed of the base film layer, the heat seal layer, and the film layer having the gas barrier function as the intermediate layer between the base film layer and the heat seal layer. The squeezing device includes the pair of packaging bag support parts for fixing the front end and the rear end of the packaging bag, and for supporting the packaging bag with the tension toward the rear direction while fixing the rear end; the squeezing mechanism part disposed to be slidable toward a front end direction in the state that the squeezing mechanism part sandwiches from above and below the rear end of the packaging bag supported with the packaging bag support parts; the driving mechanism part for driving the squeezing mechanism part to slide toward the front end direction; and the slide bar having the distal end attached to the squeezing mechanism part and being arranged in parallel to the sliding direction that the driving mechanism part drives the squeezing mechanism part to slide. The squeezing mechanism part may be a slit, and preferably includes one roller or two opposing rollers for pressing while sliding, so that it is not necessary to slide the squeezing mechanism part with a large force.

As the packaging bag used for the squeezing device of the invention, the packaging bag for a viscous liquid have to include only the bag body configured as the sheet material bonded together and made of the synthetic resin with gas barrier property, and the through hole formed in the bag body for extruding a viscous liquid to the front end outward, and an existing pouch bag can be applied. As a most simple packaging bag, the bag body is formed of the sheet materials bonded together and made of the synthetic resin with gas barrier property. A part of the front end part of the bag body is formed to protrude, so that the penetrating hole is formed therein. Further, a flexible penetrating tube with a circle or ellipsoidal shape is fused to an inner layer of the bag body. An outlet of the penetrating tube is sealed with a heat seal of the bag body.

When the packaging bag is fixed to the packaging bag support parts of the squeezing device, the front end part and the rear end part of the bag body may be fixed, so that the packaging bag is supported in an extended state. The front end part and the rear end part of the bag body may be fixed according to a shape of the packaging bag for a viscous liquid. When the rear end part of the bag body is fixed, for example, at least one supporting bar is provided at the rear end part of the squeezing device for regulating the rear end part to move in a lateral direction. The packaging bag may include a supporting hole for passing through the supporting bar, or a clamp may be provided at the rear part for sandwiching and fixing the bag body from below and above. More preferably, the rear end part of the bag body may be fixed with a rearward tension to support the bag body in an extended state.

When the front end part is fixed, in a case of the most simple packaging bag described above, for example, an opening section is provided at the front end part of the squeezing device for regulating a vertical movement of the packaging bag and freely fitting the front end of the packaging bag. The opening section has a shape and a size to freely fit the front end part of the packaging bag. More specifically, when the front end part of the packaging bag is attached to the opening section, the opening section has a depressed shape with an open upper end. After the front end part is attached to the depressed portion, the upper end part is closed to form the opening section. In addition, at least one supporting bar may be provided at the front end of squeezing device for regulating the front end part of the packaging bag in a transverse direction, and a supporting hole may be provided in the packaging bag for passing the supporting bar therethrough.

In the invention, the packaging bag for a viscous liquid includes the bag body formed of the bonded sheet material made of the synthetic resin. The packaging bag for a viscous liquid further includes the nozzle inserting piece with the flat shape in the fused state formed in the part of the edge of the bonded sheet material at the front end of the bag body; the nozzle guide hole formed in the nozzle inserting piece in the closed state for becoming the through hole when the rear end of the removable nozzle is inserted to the nozzle guide hole; and the nozzle hooking portion formed in the nozzle inserting piece for preventing the removable nozzle from coming off after the removable nozzle is attached to the nozzle inserting piece.

Accordingly, a manufacturing technology of a flexible packaging bag so-called "a pouch bag" can be used in manufacturing, so that the packaging bag can be manufactured with an existing pouch manufacturing facility. When the packaging bag is stored, it is possible to maintain good quality for a long period of time, and a large number of the packaging bags can be piled up and stored in a small space. When the packaging bag is used, it is possible to completely squeeze out the viscous liquid retained therein. After the packaging bag is used, it is possible to reduce a waste volume thereof.

The bag body of the invention may include the simple packaging bag described above or the bag body formed of the bonded sheet material made of the synthetic resin. When the bag body is produced, a whole of a circumference of the sheet material or a part thereof may be bonded and sealed with the manufacturing technique of the pouch bag.

The sheet material may be formed of a material with the gas barrier property such as a multilayer film, in which an aluminum foil is provided as the gas barrier layer. A stretched polyamide resin layer is laminated on one side of the aluminum foil, and a low density polyethylene resin layer or a non-stretched polypropylene resin layer capable of being thermally sealed is laminated on another side of the aluminum foil. More specifically, inner surfaces of the film constituting the bag body are thermally sealed around the circumference thereof. The film generally includes a laminated film formed of a plastic. A heat seal layer with a heat-seal property is laminated on one side (a backside or an innermost side) of the film, and a layer without the heat-seal property is laminated on the other side (a surface side or an outermost side) of the film.

As the most simple constitution, the film layer with the gas barrier property may be laminated as the intermediate layer between the base film layer and the heat seal layer. The base film layer may include a uniaxially or biaxially stretched film formed of polyethylene or polypropylene, a uniaxially or biaxially stretched film formed of a polyester such as polyethylene telephtalate and polyethylene naphtalate, and a uniaxially or biaxially stretched film formed of a polyamide. Especially, in terms of opening property, the uniaxially stretched film is preferred. The film may be used alone or may be laminated in multiple layers.

In order for the intermediate layer to have the gas barrier property, the intermediate layer may be formed of a film of an ethylene-vinyl acetate copolymer saponified material, polyvinylidene chloride, polyacrylonitrile, and the like. The film may be provided with an aluminum foil, a layer deposited with silica, alumina or aluminum, or a layer coated with polyvinylidene chloride, thereby improving the gas barrier property. In this case, the intermediate layer may be directly deposited or coated on an inner surface of the base film layer. Alternatively, a biaxially stretched nylon film, a biaxially stretched polyethylene terephthalate film, or a biaxially stretched polypropylene film may be separately laminated on the intermediate layer. The aluminum foil and the aluminum deposition layer are opaque and can function as a light shielding layer.

The heat-seal layer as the innermost layer may be formed of low density polyethylene, linear low density polyethylene, an ethylene a olefin copolymer, an ethylene-vinyl acetate copolymer, an ethylene-acrylic acid copolymer, an ethylene-acrylic acid ester copolymer, polypropylene or a copolymer thereby. The sheet material formed of the laminated films is bonded with the heat-sealing to form the bag body. The bag body may include a two-side sealed bag, a three-side sealed bag, a four-side sealed bag, a pillow package bag, and a gazette bag, as far as the viscous liquid does not remain in the bag body after being squeezed out.

In order to fix the front end part of the packaging bag to the squeezing device, a front plate standing upward from the front end of the squeezing device is provided with a nozzle abutting hole for abutting and supporting a sidewall of the nozzle and a locking piece slit for inserting an L shaped locking piece of the nozzle on both sides of the nozzle abutting hole, so that the front end part of the bag body with the nozzle inserted therein is fixed. In order to fix the rear end part of the packaging bag, the clamp is provided at the rear part of the bag supporting parts for clamping and fixing the bag body from below and above. Especially, the fastener formed of the linear meshing portion is disposed outside the clamp, so that the fastener is hooked outside the clamp when the squeezing mechanism part slides toward the front end, thereby securing fixing the front end part.

In the invention, the packaging bag is manufactured with a conventional production equipment through the steps including a step of forming the sheet material made of the synthetic resin with the gas barrier property in a tube shape to form the bag body; a step of fusing the nozzle inserting piece to the front end part of the bag body formed in the tube shape to form the front end part of the bag body; a step of filling the viscous liquid from the rear end part of the bag body; and a step of sealing the rear end part of the bag body.

In the invention, the flat nozzle inserting piece is fused to the part of the bonded edge of the sheet material formed at the front end part of the bag body. The nozzle inserting piece is provided with the nozzle guide hole in the closed state. When the rear end of the removable nozzle is inserted to the nozzle guide hole, the penetrating hole is formed from inside the bag body to the nozzle. The nozzle guide hole may be provided with a blocked piece inside the bag body for covering a whole portion of the nozzle guide hole. The blocked piece may have a smaller thickness at a circumferential edge of the guide hole than other portion, so that the blocked piece can be uncoupled easily when the blocked piece is pressed inside the bag body. Accordingly, when the rear end of the nozzle inserted to the nozzle inserting piece from inside the bag body is pushed into the guide hole, the penetrated hole is formed from inside the rear end part of the nozzle to the front end of the nozzle.

The rear end of the nozzle may be formed in an inclined shape relative to the insertion direction, so that the blocked piece is easily pushed inside when the rear end of the nozzle is inserted to the nozzle guide hole. When the rear end of the nozzle formed in the inclined shape abuts against the blocked piece first and is pressed further, the blocked piece at the circumferential edge of the guide hole abutting against the nozzle is broken and decoupled, thereby making it easy to push the blocked piece inside.

The nozzle inserting piece is formed of a material capable of being fused certainly to the bonded end edge of the sheet material. For example, the nozzle inserting piece is formed of a polyethylene resin or a polypropylene resin capable of being easily fused to the inner layer of the sheet material formed of a polyethylene resin or a polypropylene resin. When the nozzle inserting piece is formed in a flat shape, it is possible to reduce an amount of the viscous liquid after being squeezed out. In this case, a thickness of the nozzle inserted to the guide hole decreases. A preferred thickness is 10 mm to 30 mm, more preferably 15 mm to 20 mm. When the thickness is smaller than 10 mm, the nozzle becomes excessively thinner. When the thickness is greater than 30 mm, an excessive amount of the viscous liquid tends to remain.

In the invention, the nozzle inserting piece may have a width the same as that of the bag body. When the nozzle inserting piece has the same width, the viscous liquid tends to remain after being squeezed out. Accordingly, the nozzle inserting piece preferably has the width smaller than that of the bag body, and the width of the bag body gradually decreases toward the nozzle inserting piece in a tapered shape. The nozzle inserting piece has a depth so that the nozzle inserting piece is securely fused to the bonded end of the sheet material. To this end, a depth of the heat-seal part to which the nozzle inserting piece of the bag body is fused may be larger than that of other heat-seal part. A preferred depth is 8 mm to 20 mm, more preferable, 10 mm to 15 mm. When the depth is smaller than 8 mm, it is difficult to fuse the nozzle inserting piece to the bag body. When the depth is greater than 20 mm, the packaging bag has an excessive length. In order to securely fuse the nozzle inserting piece to the bonded edge of the sheet material, the bonded edge may be provided with a fin for enlarging a fusion area, or a protrusion may be provided on a bonded side in the width direction.

In the invention, the packaging bag includes the nozzle hooking portion for preventing the removable nozzle from coming off after the rear end of the removable nozzle is inserted to the nozzle guide hole to form the through hole. Specifically, the nozzle hooking portion is provided just for maintaining the rear edge of the nozzle inserted into the guide hole. The nozzle hooking portion is preferably capable of being disposed in the nozzle inserting piece with a flat shape, and may include the hooking part formed at a side of the nozzle guide hole for hooking to the hooked part formed at a distal end of the L-shaped hooking piece extending from the side of the removable nozzle to the rear end. As far as the hooking part is capable of hooking to the hooked part, the hooking part may be provided on the L-shaped hooking piece, and the hooked part may be provided on the nozzle inserting piece.

In the invention, the packaging bag for a viscous liquid can be manufactured easily using the manufacturing technique of the pouch bag. Namely, the packaging bag can be manufactured through the steps including the step of shaping the film in the tube shape to form the bag body; the step of fusing the nozzle inserting piece to the front end part of the bag body formed in the tube shape to form the front end part of the bag body; the step of filling the viscous liquid from the rear end part of the bag body; and the step of sealing the rear end part of the bag body. In this case, the step of shaping the film in the tube shape to form the bag body and the step of sealing the rear end part can be performed with the manufacturing technique of the pouch bag without change. Further, the manufacturing technique of the pouch bag is also utilized to fuse the nozzle inserting piece to the front end part of the bag body formed in the tube shape to form the front end part of the bag body. More specifically, the bag body is placed in a metallic mold for the heat sealing, and the nozzle inserting piece is placed inside the front end edge of the bag body, so that the nozzle inserting piece is thermally sealed.

The viscous liquid sealed in the bag body may include a liquid with a high viscosity such as a sealing agent (a caulking agent) for water tight sealing in construction and an adhesive agent for adhering a material. The viscous liquid is not limited to these and may be any liquid capable of being guided through the nozzle. The viscous liquid may further include a viscous liquid of a two-liquid mixing type, in which two liquid are guided and mixed to be a desirable mixture upon discharging from the nozzle. In this case, the bag body is divided into two compartments and liquids are filled in the compartments, so that the liquids are mixed in and discharged through the nozzle inserted to one or two nozzle inserting guide holes. Alternatively, the bag body filled with a liquid is individually piled or aligned in the squeezing device, and the liquids are mixed in and discharged through the nozzle inserted to the nozzle inserting guide hole.

Furthermore, the viscous liquid may include a liquid containing an organic solvent such as a sealing agent and a solvent-based adhesive agent. When the viscous liquid containing an organic solvent is filled into the bag body and the bag body is thermally sealed, it is necessary to use a manufacturing machine with fire preventing equipment such as air infiltration due to combustible nature of an organic solvent. To this end, in the invention, the packaging bag for a viscous liquid has the fastener formed of the linear meshing portion extending in the width direction of the bag body at the inner face of the rear end edge of the bag body. Accordingly, it is not necessary to install a manufacturing machine with fire preventive equipment.

In this case, a step of forming the fastener at the rear edge of the bag body is performed before the step for filling the viscous liquid. It is possible to use the manufacturing technique of the pouch bag for forming the fastener. More specifically, a fastener tape engaged each other is aligned on the inner surface of the bag body at the rear end thereof in the width direction, and a corresponding tape part is heat-sealed, thereby easily and safely forming the fastener.

The viscous liquid is filled into the bag body obtained in a filling room with sufficient ventilation. After the fastener is engaged and sealed, the packaging bag is transported to a heat seal device, so that the bag body is sealed outside and inside the fastener on the width direction. The squeezing device includes the clamp for clamping and fixing the rear end of the bag body from below and above. Accordingly, when the squeezing mechanism part slides, the fastener is hooked outside the clamp, thereby securely holding the packaging bag.

As described above, in the invention, it is possible to provide the squeezing device for squeezing a viscous liquid in the packaging bag using an existing pouch bag. In addition, it is possible to provide the packaging bag for a viscous liquid capable of being manufactured with an existing manufacturing machine. When the packaging bag is stored, it is possible to maintain good quality for a long period of time, and a large number of the packaging bags can be stored in a small space. When the packaging bag is used, it is possible to completely squeeze out the viscous liquid retained therein. After the packaging bag is used, it is possible to reduce a waste volume thereof.

BRIEF DESCRIPTION OF THE DRAWINGS

FIG. 1 is a view showing a configuration of a squeezing device according to an embodiment of the invention, wherein

FIG. 4 is a view showing a configuration of a packaging bag for a viscous liquid fixed to the squeezing device shown in FIG. 1 according to an embodiment of the invention, wherein

FIG. 5 is a view showing a configuration of a nozzle inserting piece of the packaging bag for a viscous liquid shown in FIG. 4, wherein

FIG. 6 is a view showing a configuration of a nozzle attached to the nozzle inserting piece shown in FIG. 5, wherein

FIG. 7 is a view showing a configuration of a fixing portion of the squeezing device at a front end thereof shown in FIG. 1 in case of using the packaging bag for a viscous liquid shown in FIG. 4, wherein

EXPLANATIONS OF REFERENCE NUMERALS

3 bag body, 10 squeezing device, 11 bag body supporting part, 12 squeezing mechanism part, 13 driving mechanism part, 14 front plate, 15 rear plate, 16 guide bar, 16*a* race for central slide, 17 grip, 18 trigger, 19 sliding bar, 20 axis of rotation, 21 upper and lower roller, 22 roller supporting frame, 23 locking part, 24 hinge part, 25 portion of the opening, 25*a* concave portion, 25*b* upper edge, 26 supporting bar, 27 grip, 28 hinge, 29 attachment, 30 packaging bag, 31 supporting hole, 32 bag body, 33 penetrating tube, 34 linear fastener, 35 notch, 40 packaging bag, 42 bag body, 44 linear fastener, 46 stuck edge part, 48 gazette, 50 nozzle inserting piece, 51 fin, 52 nozzle inserting guide hole, 53 protrusion, 54 block piece, 56 concave portion, 58 hook part, 60 nozzle, 62 rear end edge part of nozzle 64 L shaped locking piece, 65 part to be hooked, 66 flange part, 74 front plate, 75 nozzle abutting hole, 76 hook piece slot

PREFERRED EMBODIMENTS OF THE INVENTION

Figure 1A:
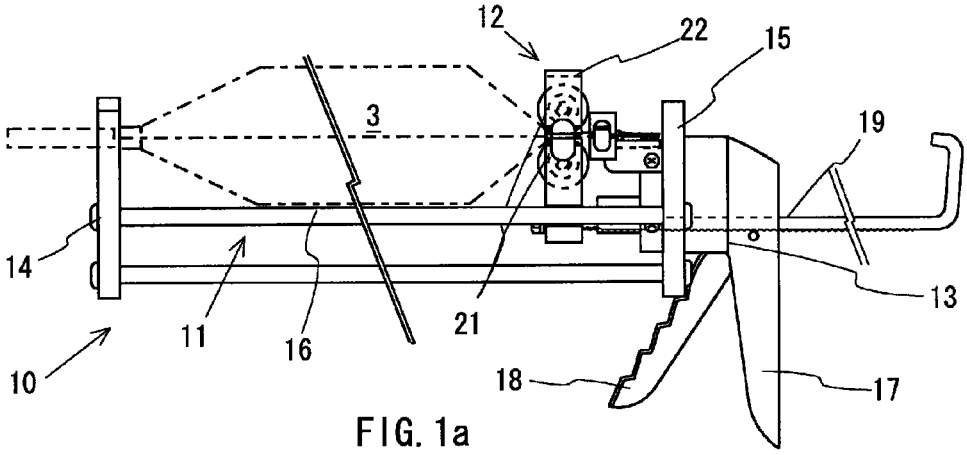
FIG. 1*a* is a lateral view thereof before squeezing.
Figure 1B:
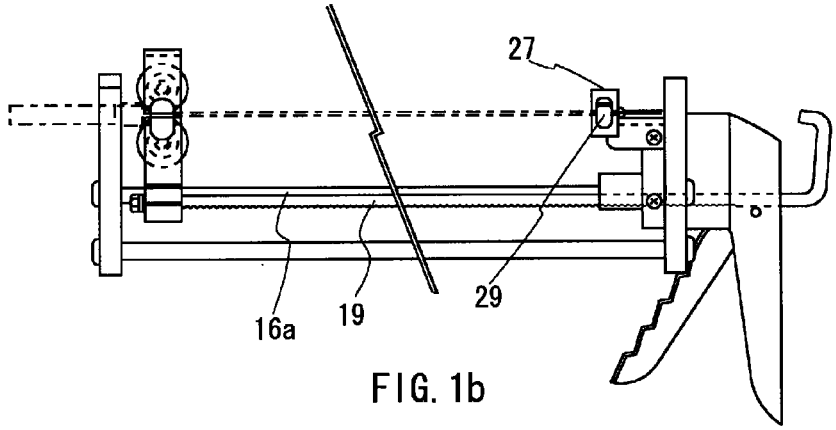
FIG. 1*b* is a lateral view thereof after squeezing.
Figure 1C:
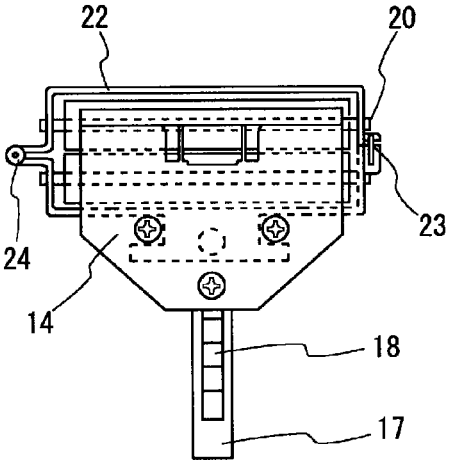
FIG. 1*c* is a front view thereof.
Figure 1D:
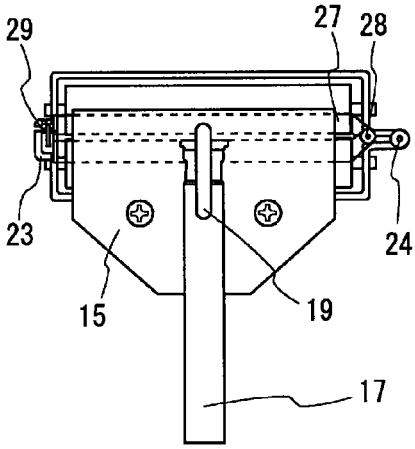
FIG. 1*d* is a rear view thereof.
Figure 2:
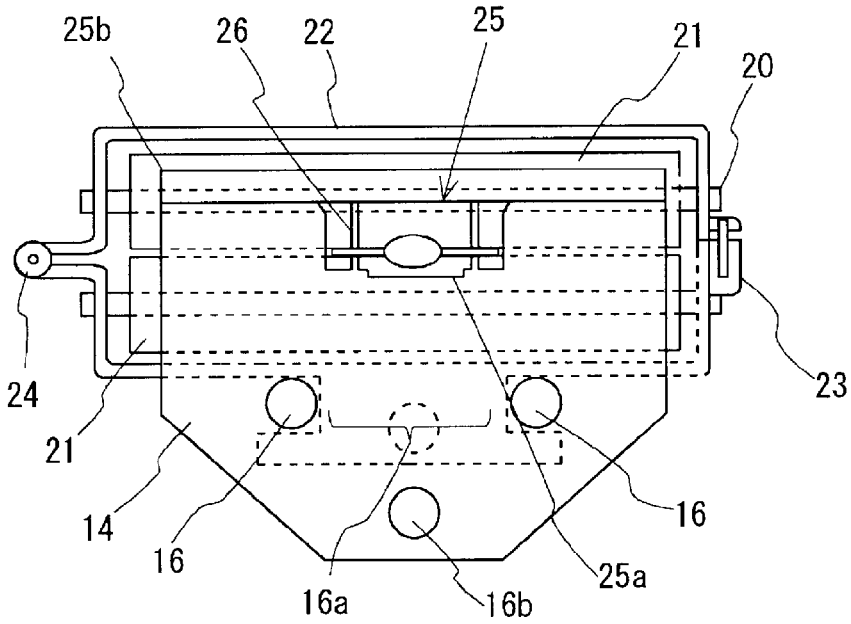
FIG. 2 is an enlarged view of FIG. 1*c;*
Figure 3:
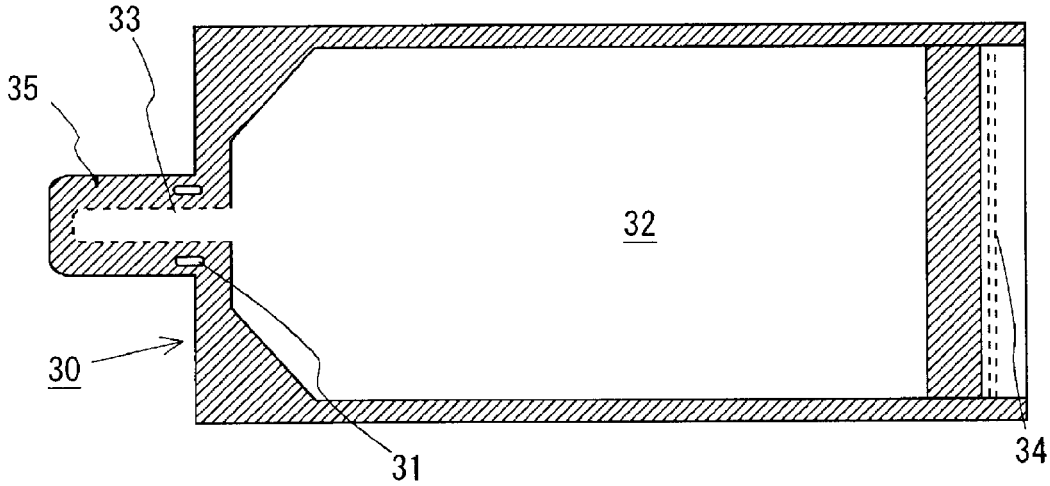
FIG. 3 is a view showing a configuration of a simple packaging bag fixed to the squeezing device shown in FIG. 1.
Figure 4A:
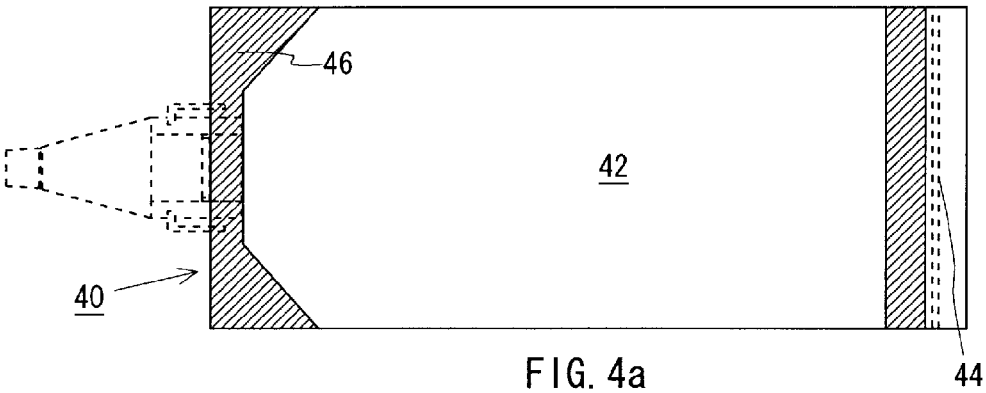
FIG. 4*a* is a horizontal view thereof.
Figure 4B:
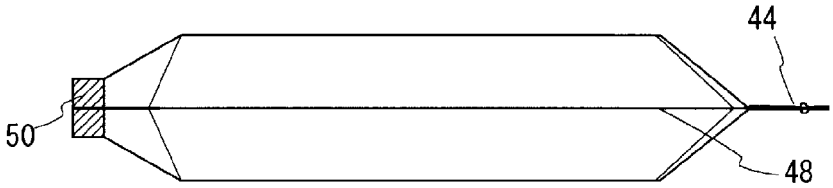
FIG. 4*b* is a side view thereof.
Figure 4C:
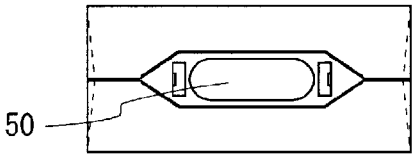
FIG. 4*c* is a front view thereof.
Figure 4D:
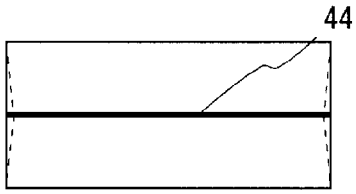
FIG. 4*d* is a rear view thereof.

FIG. 1 is an illustrative drawing showing constitution of an example of squeezing device of the invention. FIG. 2 is an enlarged view of FIG. 1*c*. FIG. 3 is an illustrative drawing showing constitution of simple packaging bag placed to squeezing device of FIG. 1. FIG. 4 is an illustrative drawing showing constitution of an example of packaging bag for viscous liquid of the invention placed to squeezing device of FIG. 1. FIG. 5 is an illustrative drawing showing constitution of nozzle inserting piece of packaging bag for viscous liquid of FIG. 4. FIG. 6 is an illustrative drawing showing constitution of nozzle fixed to nozzle inserting piece of FIG. 6. FIG. 7 is an illustrative drawing showing constitution of fixing means of front end of squeezing device of FIG. 1 in the case of using packaging bag for viscous liquid of FIG. 4.

As shown in FIG. 1*a* to FIG. 1*d*, squeezing device 10 of the invention comprises bag body supporting part 11 which supports front end and rear end of bag body 3 of packaging bag sideway in the state of fixing, squeezing mechanism part 12 equipped slidable to front end direction in the state clipping rear end of bag body 3 supported by the bag body supporting part from upper and lower part and driving mechanism part 13 driving the squeezing mechanism part sliding toward front end. Bag body supporting part 11 is configured as front plate 14 allocated at front end of squeezing device 10, rear plate allocated at rear end and 3 linking bar 16, 16*b* linking these and is tried to trim weight. Among these 3 linking bar, upper pair of linking bar 16 functions as guide bar and space between linking bar 16 is configured as central slide guide groove 16*a*. Grip 17 and trigger 18 are set at the rear side of bag body supporting part 11. In central slide guide groove 16*a*, slide bar 19 equipped with squeezing mechanism part 12 at the front end is allocated which is movable toward the front end.

Squeezing mechanism part 12 comprises sliding part which slides in central slide fitting freely guide groove 16*a* at the bottom, and a pair of upper and lower roller 21 comprising a pair of rotation rod 20 crossing slide direction at the top. Upper and lower roller 21 is openable by hinge 24 by releasing lock part 23 of roller supporting frame 22 supporting each rotation rod 20. Slide bar 19 comprises ratchet drive mechanism (not shown) allocated at the back of bag body supporting part 11, by drawing operation by grip 17 and trigger 18 by ratchet driving mechanism proceed slide bar 19 with a definite pitch and push squeezing mechanism part 12 to move. Squeezing mechanism part 12 squeezes bag body 3 sequentially by moving squeezing mechanism part 12 toward front end with nozzle in the state of sandwiched in rear end of bag body 3 between upper and lower roller 21. In addition, mechanism to proceed slide bar 19 with definite pitch toward front end direction may employ nail feeding mechanism sending with a definite pitch meshing tooth which is formed many tooth under slide bar 19 other than ratchet driving mechanism.

Fixation of packaging bag equipped to the squeezing device 10 to bag body supporting part 11 has only to fix and hold front end and rear end of bag body 3 in tension and is selected according to constitution or form of bag body 3. For example, simple packaging bag 30 shown in FIG. 3 comprises circle or elliptic flexible penetration tube 33 which fuse to inner layer of bag body as through hole inside protruding a part of front end part of bag body 32 configured as sticking sheet materials made of synthetic resin with gas barrier, is used by cutting front end of penetrating tube 33 of bag body with extruding exit sealed with bag body 32 by heat-seal of exit of this penetrating tube 33. Rear end part of bag body 32 linear fastener 34 allocated. In addition, heat-seal part has notch 35 to open easily by hand.

For packaging bag for viscous liquid of FIG. 3, stretched polyamide copolymer is used at one side of gas barrier layer deposited with aluminum foil to polyacrylonitrile to bag body 32 and at another side multilayer film etc. layered with low density polyethylene resin layer. Bag body is produced by heat-sealing of both end of longer direction with low density polyethylene resin layer inside and after cutting this at desired length, front end is formed by heat-sealing to protruding state inserting penetrating tube to front end part. Continuously, it is integrated by heat-seal fused with linear fastener tape at rear end. Linear fastener 34 is opened, sealing agent is filled, and linear fastener 34 is closed and heat-sealed outside of linear fastener 34.

Fixation to bag body supporting part 11 of squeezing device 10 of bag body 32 of this FIG. 3 is done by fixing front end and rear end of bag body 32. Means of fixation of front end comprises open part 25 to regulate movement in longitudinal direction fitting front end of bag body 30 freely to front plate 14 of squeezing device 10. Opening section 25 is formed by placing upper edge 25*b* above front plate 14 to cover in depressed portion 25*a* formed in main body of front plate. In addition, a pair of supporting rod 26 to regulate movement of front end of packaging bag 30 to width direction is placed in depressed portion and supporting hole 31 set in packaging bag 30 is equipped.

Means for fixation of rear end of bag body 32 is done by holding tool 27 which clips bag body 32 from upper and lower direction to fix at the back of bag supporting body 12. In this case, by placing linear fastener 34 of bag body 23 outside of holding tool 27, linear fastener 34 is hooked outside of holding tool 27 by sliding toward front end direction of squeezing mechanism part 12 and is fixed with certainty. In addition, holding tool 27 is fixed as upper and lower roller 21, by fixing upper and lower holding tool linked with hinge 28 at one side with other clip 29 (so-called "batin lock").

As shown in FIG. 4*a* to FIG. 4*d*, packaging bag 40 of another embodiment of the invention comprises bag body 42 configured as sticking sheet materials of synthetic resin with gas barrier property, flat nozzle inserting piece 50 fused to a part of stuck edge of sheet material at front end edge of this bag body 42 and linear fastener 44 formed at rear end edge of bag body 42. Bag body 42 is constituted as bag body 42 with gazette using multilayer film etc. multilayered with stretched polyamide resin on one side of gas barrier layer deposited with aluminum foil on polyacrylonitrile and on another side multilayered with low density polyethylene resin.

Figure 5A:
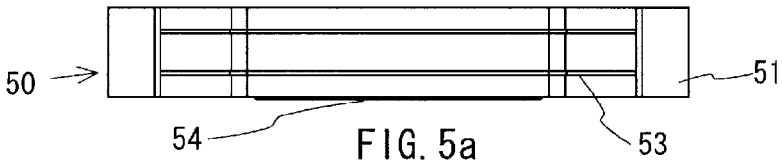
FIG. 5*a* is a horizontal view thereof.
Figure 5B:
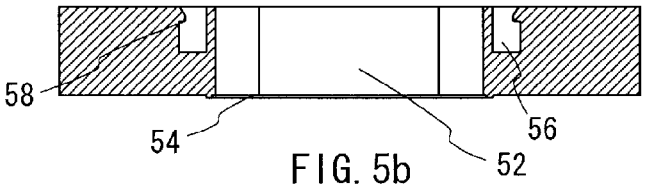
FIG. 5*b* is a cross-sectional view thereof.
Figure 5C:
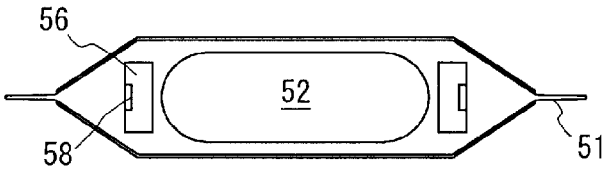
FIG. 5*c* is a front view thereof.

As shown in FIG. 5*a* to FIG. 5*c*, outlook of nozzle inserting piece 50 is hexagonal pole structure with flat front and fin 51 at both side and two protrusion at the side of hexagonal pole to fuse well at heat-sealing buried to stuck end part 46 of sheet material. Nozzle inserting piece has unpenetrated nozzle inserting guide hole 52 and depressed portion 52 at both side of it. Specifically, at both inner side of guide hole 52, blocked piece is formed to cover whole area of guide hole 52 which is unpenetrated.

Figure 6A:
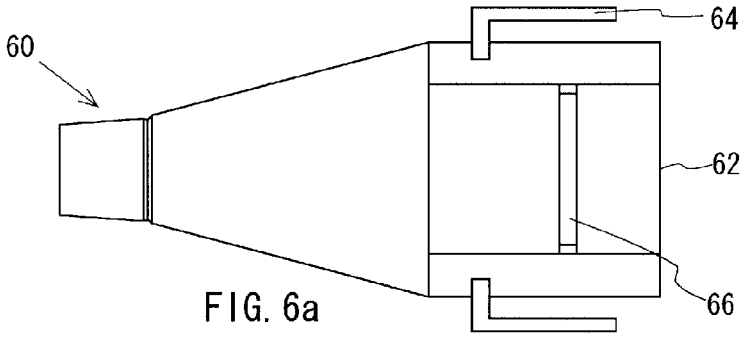
FIG. 6*a* is a horizontal view thereof.
Figure 6B:
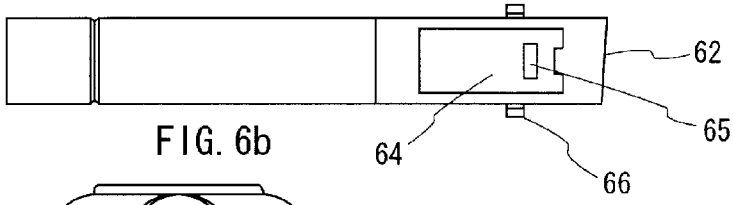
FIG. 6*b* is side view thereof.
Figure 6C:
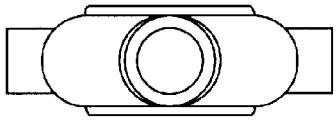
FIG. 6*c* is a front view thereof.

Blocking piece 54 departs to interior direction by inserting inside of guide hole 52 with rear edge 62 of nozzle 60 of FIG. 6*a* to FIG. 6*c* and through hole is formed from inside of nozzle end edge 62 inserted to guide hole 52 of nozzle inserting piece 50 from inside of bag body 42 to nozzle 60 front end. On upper and lower surfaces of nozzle 60, flange part 66 is formed and prevent further insertion to guide hole 52 of rear end edge 62.

As shown in FIG. 5*b*, in a pair of depressed portion 56, hook part 58 is formed each inside. This hook part 58 prevent departure from nozzle inserting piece 50 by engagement with hook part under 65 formed at front end of L shaped locking piece 64 stretched toward rear end edge direction from side of nozzle 60 of FIG. 6. In addition, although nozzle 60 is tapered nozzle, front end part may be flat plate like spurtle or may be nozzle front end forming V shaped groove or protrusion.

Packaging bag 40 for viscous liquid of FIG. 4 like packaging bag 30 of FIG. 3. After bag body is produced by heat-sealing both end of longitudinal direction with low density polyethylene resin inside and is cut at desired length. Forming gazette 48, inserting nozzle inserting piece 50 into front end and heat-sealed to combine and linear fastener tape is inserted at rear end and heat-sealed to combine. Sealing agent is filled into bag body 42 by opening linear fastener 44 and linear fastener 44 is closed innderside of which is heat-sealed.

Figure 7A:
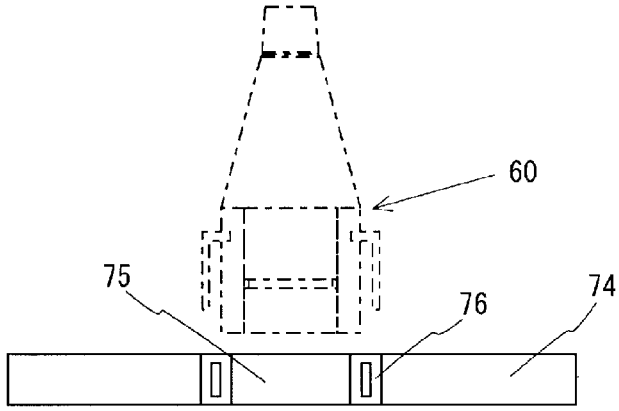
FIG. 7*a* is a horizontal view thereof.
Figure 7B:
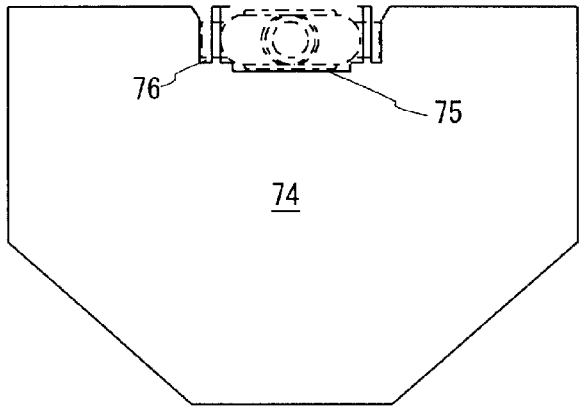
FIG. 7*b* is a front view thereof.

Fixation means of front end is done at front plate 74 different from said front plate 14. In addition, as only front plate of squeezing device shown in FIG. 1 is different, the same code is attached for other constitution. As shown in FIG. 7*a* and FIG. 7*b*, front plate 74 which raise up from front face of bag body support 12 comprises nozzle contacting hole 75 contacting and supporting to side wall of nozzle 60 and hooking piece slit 76 penetrating L shaped hooking piece 64 of nozzle 60 and front end part of bag body 42 inserted with nozzle 60 is fixed. In addition, after setting bag body 42 covering upper face of this front plate 74 with retainer plate, fixation is made more certain by covering upper face of contact hole 75 and slit 76 with upper edge part. In addition, means for fixing rear end part is done by holding tool 27 fixing by clip bag body 42 from upper and lower direction at the back of bag body support 12 as said bag body 32. In this case, by placing linear fastener 44 of bag body 42 outside of holding tool 27, it is the same that fixation is made more certain and so on.

As end status of squeezing, by upper and lower roller 21, as nozzle inserting piece 50 is flat, inner sealing agent (viscous liquid) can be squeezed out. In addition, as much sealing agent remained in guide hole of nozzle inserting piece 50 remains in rear end part of nozzle; it can be carried over together in time of changing nozzle 60 to other packaging bag 40 for viscous liquid. Thus, there is advantage that the more the same kind of sealing agent is used, the less the remaining sealing agent in bag body it becomes.

What is claimed is:

1. A packaging bag for a viscous liquid, comprising:

a bag body having a through hole at a front end thereof for pushing a viscous liquid outside, said bag body being formed of a bonded sheet material made of a synthetic resin, said sheet material being formed of a base film layer, a heat seal layer, and a film layer having a gas barrier function as an intermediate layer between the base film layer and the heat seal layer;

a nozzle inserting piece with a flat shape in a fused state, said nozzle inserting piece being formed in a part of an edge of the bonded sheet material at the front end of the bag body;

a nozzle guide hole formed in the nozzle inserting piece in a closed state for becoming the through hole when a rear end of a removable nozzle is inserted to the nozzle guide hole; and a nozzle hooking portion formed in the nozzle inserting piece for preventing the removable nozzle from coming off after the removable nozzle is attached to the nozzle inserting piece.

2. The packaging bag for a viscous liquid according to claim 1, wherein said nozzle hooking portion includes an L-shaped hooking piece extending from a side of the removable nozzle to the rear end, a hooked part formed at a distal end of the L-shaped hooking piece, and a hooking part formed at a side of the nozzle guide hole for hooking to the hooked part.

3. The packaging bag for a viscous liquid according to claim 1, further comprising a fastener formed of a linear meshing portion extending in a width direction of the bag body at an inner face of a rear end edge of the bag body.

* * * * *